US006279707B1

(12) United States Patent
Godshaw et al.

(10) Patent No.: US 6,279,707 B1
(45) Date of Patent: Aug. 28, 2001

(54) CONTOURED CARRYING CASE AND LUGGAGE

(75) Inventors: Donald E. Godshaw, Evanston; Andrezj Redzisz, Skokie, both of IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 09/513,413

(22) Filed: Feb. 25, 2000

(51) Int. Cl.[7] ..... A45C 3/00; A45C 13/26; A45C 13/36

(52) U.S. Cl. ..... 190/127; 190/39; 190/115; 150/130; 220/914; 383/907

(58) Field of Search ..... 206/316.2; 220/914; 150/100, 107, 130; 190/117, 127, 39, 115; 383/907

(56) References Cited

U.S. PATENT DOCUMENTS

| | | | | |
|---|---|---|---|---|
| 1,809,696 | * | 6/1931 | Heilweil | 220/324 X |
| 2,691,401 | * | 10/1954 | Kontoff et al. | 206/316.1 |
| 3,910,470 | * | 10/1975 | Swenson et al. | 206/316.2 |
| 5,954,170 | * | 9/1999 | Chisholm | 150/107 |

* cited by examiner

*Primary Examiner*—Sue A. Weaver
(74) *Attorney, Agent, or Firm*—Banner & Witcoff, Ltd.

(57) ABSTRACT

A carrying case or luggage includes a concave curved side panel to facilitate positioning of the luggage when held by hand straps or a shoulder strap against the hip or leg of a user or person carrying the luggage.

9 Claims, 4 Drawing Sheets

FIG. 3
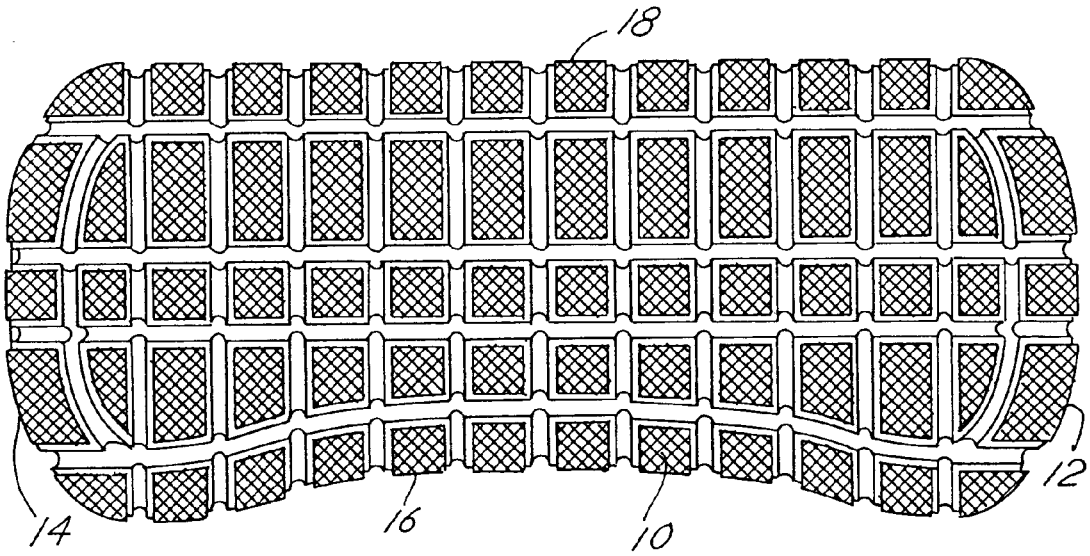
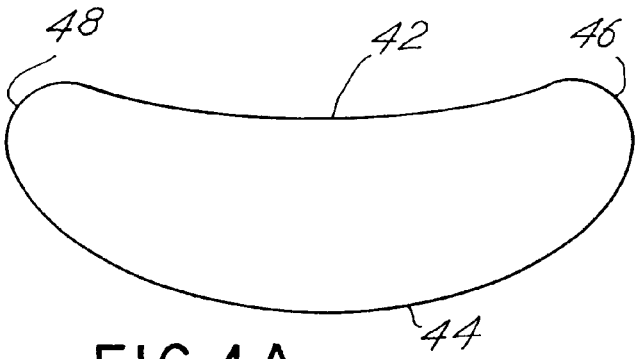
FIG. 4A
FIG. 4
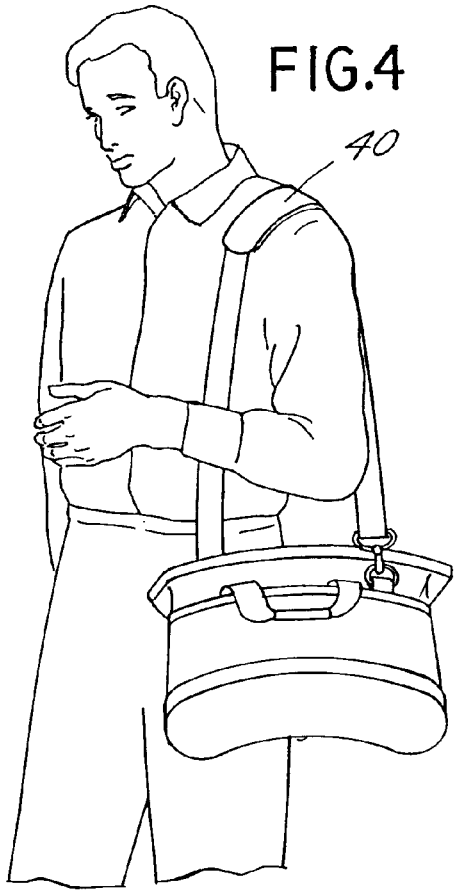

CONTOURED CARRYING CASE AND LUGGAGE

BACKGROUND OF THE INVENTION

This invention relates to luggage or a carrying case which is contoured to facilitate carrying of the luggage by handles or by a shoulder strap.

When carrying a computer, business papers, clothing or other items, it is often necessary to retain the items in a carrying case or item of luggage which maintains a generally rigid shape, particularly the plan profile shape. Maintenance of shape facilitates protection of items within the luggage or carrying case. It may also facilitate packing of the luggage or case. Finally, it may facilitate stacking or storage of the luggage or case.

Typically, luggage and carrying cases of the type referenced have a rectangular, parallel-piped shape. Consequently, carrying such items is often is uncomfortable and unyielding. For example, prior art shapes may rub uncomfortably against the side of the person carrying the case or luggage. The present invention provides a design alternative to prior art luggage and carrying case constructions which is easier to utilize and carry.

SUMMARY OF THE INVENTION

Briefly, the present invention comprises luggage having a bottom panel which defines the plan profile of the luggage. End panels and opposite side panels along with a top panel having an access opening, for example, a zipper opening, define the remaining enclosure of the luggage or carrying case. Extra pockets or pouches may be incorporated on one or more of the panels other than the bottom panel. Importantly, one side panel, which does not include any extra pouches or pockets has a curved profile. The concave curved profile enables carrying of the luggage against one side of a person's body so that the luggage conforms to the shape of the body of the carrier and will be more easily carried, will not jostle the user when being carried, and will stay in position when being carried.

Thus, it is an object of the invention to provide an improved carrying case or luggage which may be more easily handled and manipulated.

It is a further object of the invention to provide a piece of luggage or case which includes one side panel having a concave channel or configuration.

It is a further object of the invention to provide luggage which is easily carried easily, handled and which has full storage capacity, is capable of having a form and shape, and is capable maintaining that form and shape for ease of access to the interior of the luggage.

These and other objects, advantages, and features of the invention will be set forth in the detailed description which follows.

BRIEF DESCRIPTION OF THE DRAWING

In the detailed description which follows, reference will be made to the drawing comprised of the following figures:

FIG. 3 is a bottom plan view of the bottom of the carrying case of FIG. 1;

FIG. 4 is an isometric view depicting the manner of use of the bag of FIG. 1;

FIG. 4A is a plan view of an alternative bag configuration;

DESCRIPTION OF THE PREFERRED EMBODIMENT

Figure 1:
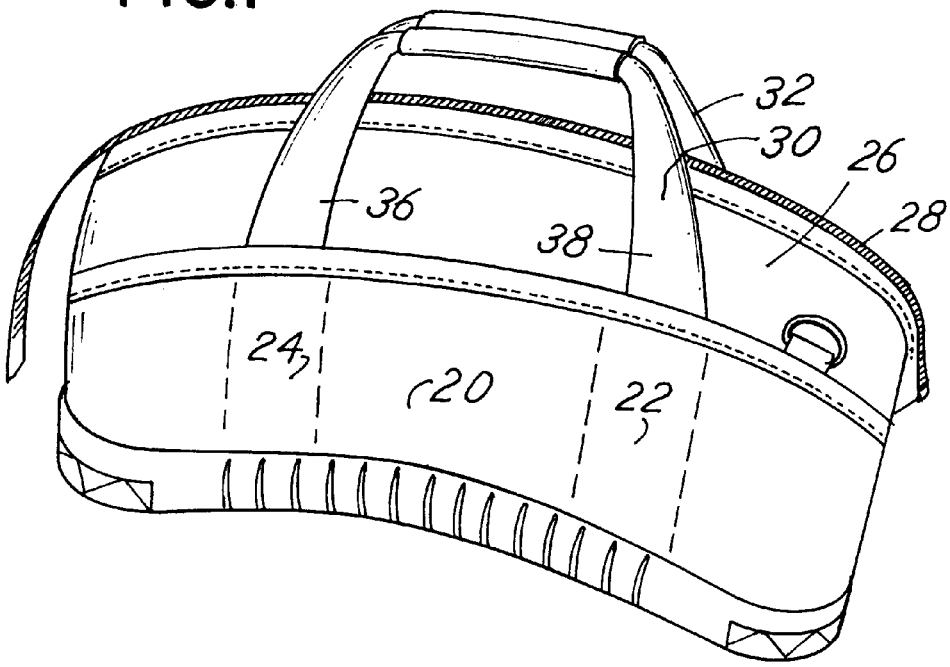
FIG. 1 is an isometric view of a first embodiment of the luggage or case of the invention viewed from a first side panel depicting the concave shape thereof.
Figure 2:
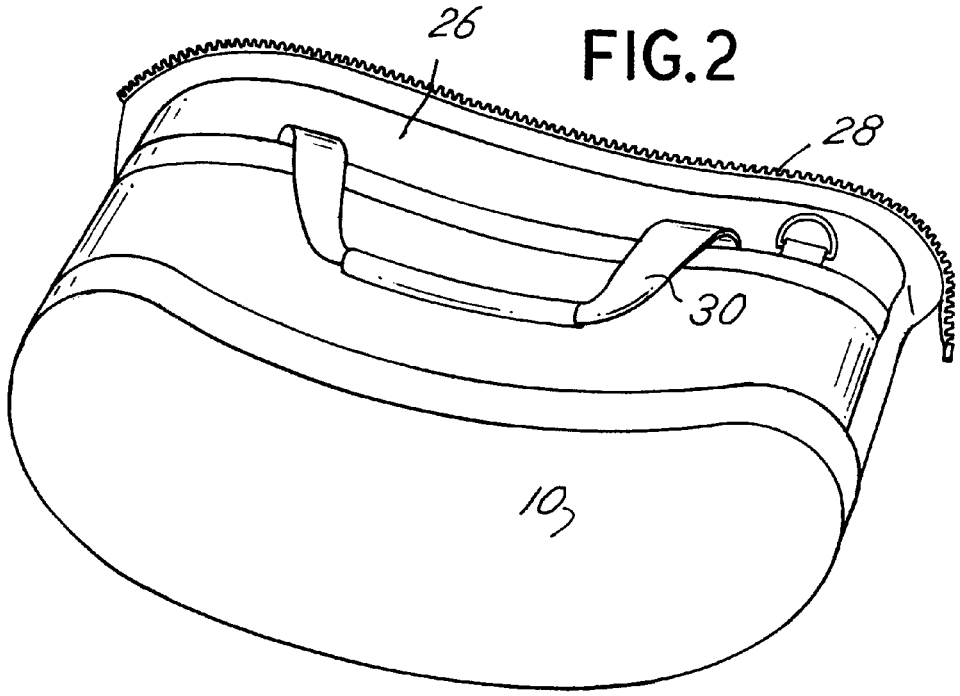
FIG. 2 is an isometric view of the case of FIG. 1 viewed from the underside thereof.
Figure 5:
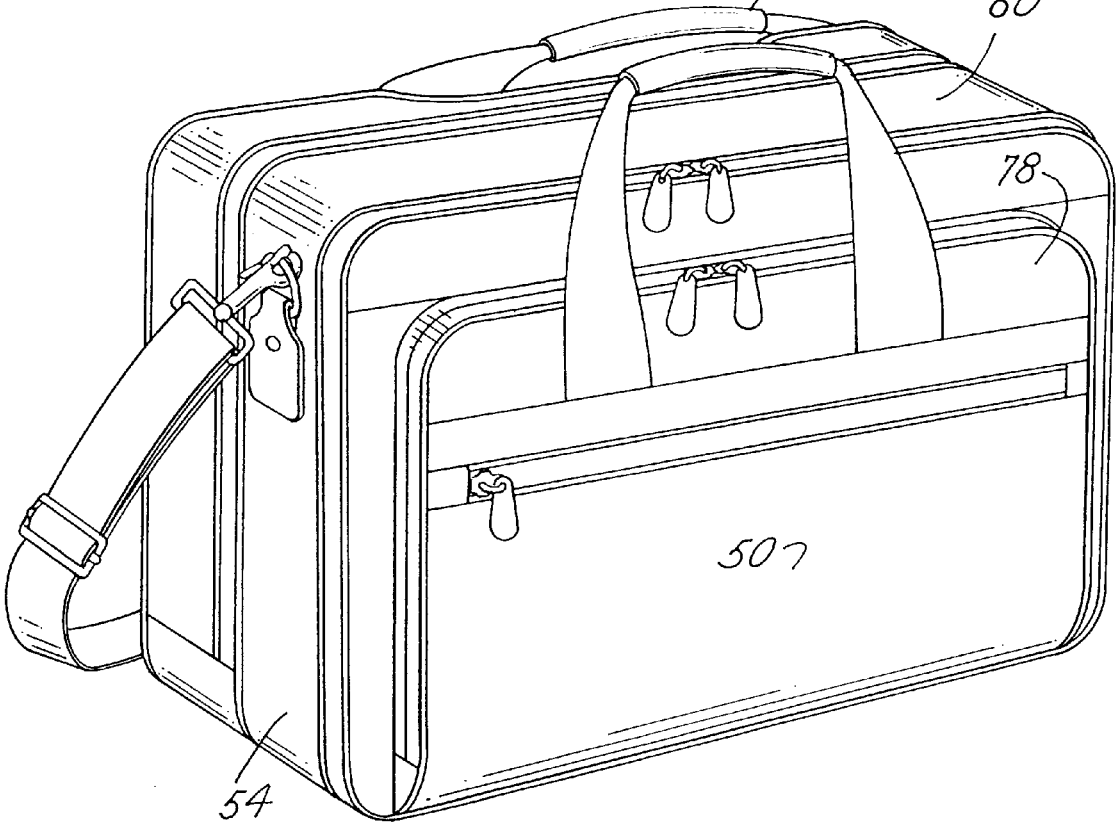
FIG. 5 is an isometric view of an alternative embodiment of the invention as viewed from the side or second side panel thereof.
Figure 6:
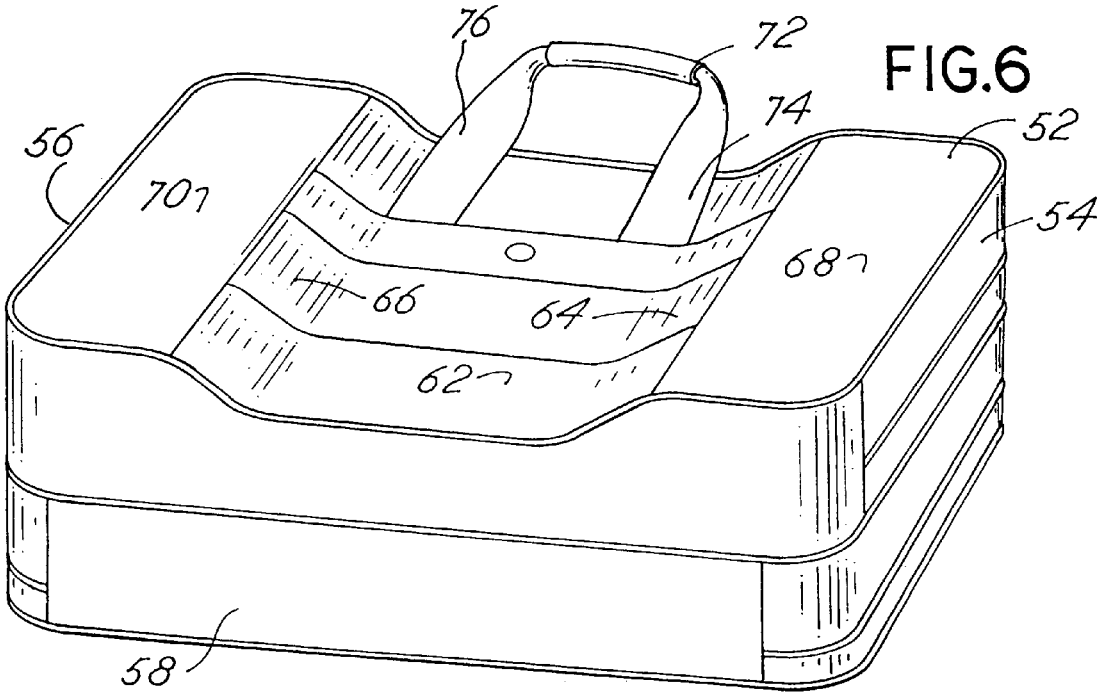
FIG. 6 is an isometric view of the case of FIG. 5 viewed from the bottom side thereof.
Figure 7:
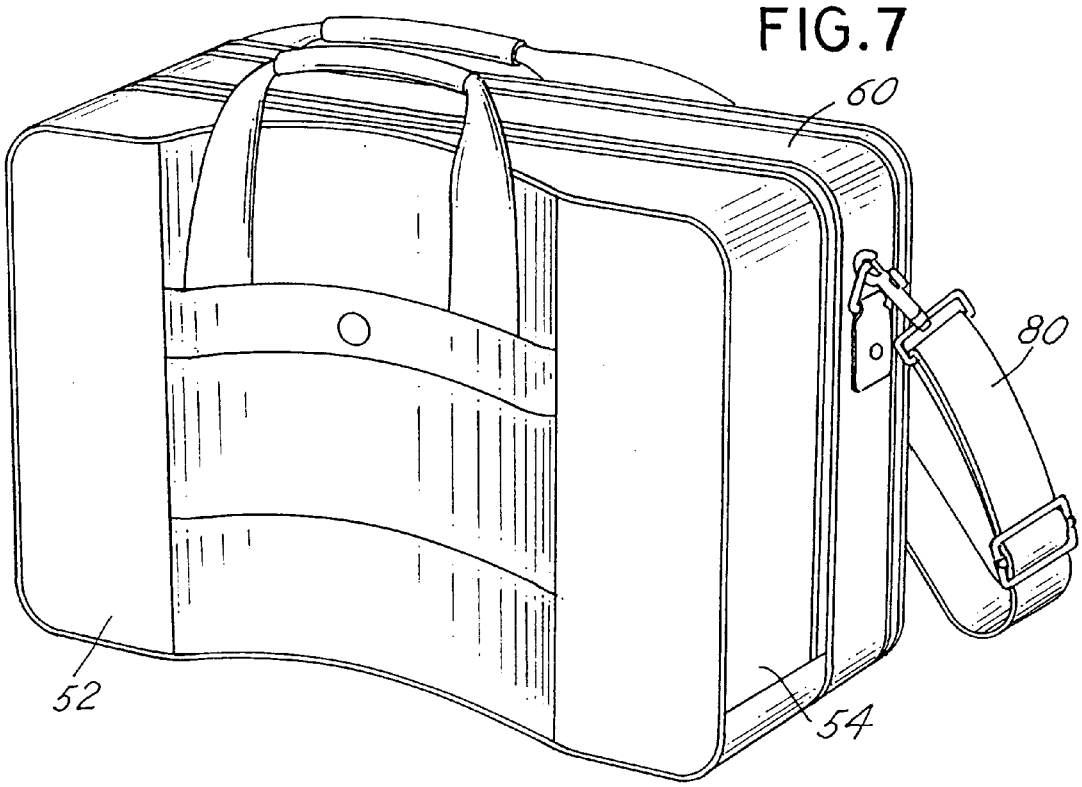
FIG. 7 is an isometric view of the carrying case of FIG. 5 viewed from the side panel side thereof depicting the concave curvature thereof.
Figure 8:
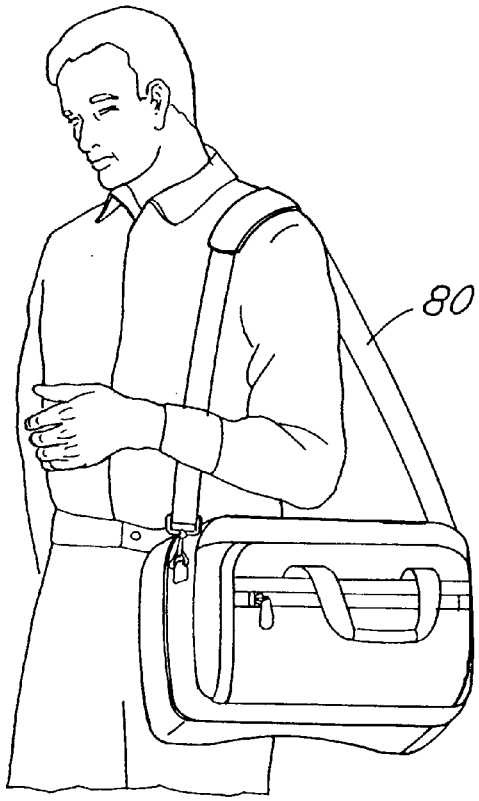
FIG. 8 is an isometric view illustrating the manner of use of the case of FIG. 5 when being carried.

FIGS. 1–4 depict a first embodiment of the invention and FIGS. 5–8 depict a second embodiment. The embodiment of FIGS. 1–4 has a generally kidney shaped profile. The embodiment of FIGS. 5–8 has a generally rectangular profile with a concave side portion or section.

Referring to FIGS. 1–4, the embodiment includes a bottom panel 10 particularly as depicted in FIG. 3. The bottom panel has a first end 12 and a second end 14, a first side 15 which is correlated with a first baggage side panel 16 and a second side 17 correlated with a second baggage side panel 18. The ends 12, 14 are arcuate in shape and curved slightly. The second side panel 18 is generally planar and flat. The first side panel 16 is concave curved. The first side panel 16 thus includes a concave central section 20 with side margins 22 and 24 as shown in phantom in FIG. 1.

The bottom profile, shown in FIG. 3, therefore defines the general contour and shape of the case or baggage comprised of the various sides 12, 14, 15, 16, 17 and 18 as well as the bottom panel 10. A top panel 26 completes the enclosure of the case of the case. The top panel 26 has a shape which conforms with or is congruent with the shape of the bottom panel 10 shown in FIG. 3. Panels 10, 26 are typically congruent, overlay one another, and are spaced by the vertical dimension of the side and end panels 12, 14, 17 and 18. A zipper 28 defines and connects the margin between the top panel 26 and side panel 18. The zipper 28 thus defines an opening which follows the contour of the bag.

Handles 30, 32 are attached to the side panels 16, 18. The handle 30 connects with the side panel 16 at the margin of that panel 16 with the top panel 26. A stiffening element, rib or member 31 is provided at the margin also. Importantly, the handle 30 includes opposite strap ends 36, 38 which are connected respectively to the margin regions 22, 24 respectively of side panel 16. The handle 32 is likewise positioned and connected to the opposite side panel 18 in a symmetric manner.

The profile of the bag depicted in FIGS. 1–4 enables a user of the bag to position the concave curved portion against their leg. Thus, a strap 40 which is attached to the bag enables the bag to be comfortably positioned against the hip or leg of the individual carrying the bag. In the embodiment of FIGS. 1–4, which is depicted, the profile of the bag is that which is represented by the bottom panel 10 in FIG. 3.

An alternative and closely related shape would have the profile of FIG. 4A; namely, a kidney shaped bottom. In the example of FIG. 4A, a concave side 42 has an opposite side 44 which is smoothly connected by end curves or sections 46,48 to define a profile which, again, may be comfortably positioned against the hip of a user or person carrying the bag.

FIGS. 5–8 illustrate an embodiment of the invention which incorporates features of typical rectangular parallelpiped carrying cases in combination with the curved construction to facilitate carrying represented by FIGS. 1–4. That is, referring to FIG. 5, there is depicted a bag having a second side panel 50, a first side panel 52, an end panel 54, a second end panel 56, a bottom panel 58 and a top side or panel 60. The first side panel 52 includes a generally concave, vertical center section 62 having margins 64 and 66 on the opposite sides thereof which connect to planar sections 68, 70 respectively. A handle 72 has strap connectors 74, 76 attached respectively to the margins 64, 66 of the curved or concave section 62 by stiffening member 63. Additional pockets, for example, outer pocket 78 may be positioned and attached to the side panel 50. Zippers and other access fasteners are provided. A strap 80 is attached to the luggage of FIGS. 5–8 to support the luggage in a manner whereby the concave portion or section is again positioned against the hip of a user. This enhances the comfort and ease of portability of the luggage.

It is noted that three different profiles, within the context of the invention, have been disclosed. Additionally, with respect to each profile, various compartments and pouches may be included and incorporated in the luggage or carrying case, particularly on side panels. Ingress and egress to the carrying case is facilitated by access zippers, for example, or other opening and closing fasteners. The combination of the concave profile, along with the carrying straps and handle straps, and the position thereof as attached to the carrying case enable the case to be utilized in the fashion designed and desired. Thus, the invention is to be limited only by the following claims and equivalents thereof.

What is claimed is:

1. Luggage comprising, in combination:

a bottom panel;

first and second spaced, opposite end panels, connected to the bottom panel;

first and second spaced opposite side panels connected to the end panels and bottom panel to form a storage enclosure;

a top panel connected to the end and side panels, said top panel including an access opening to the enclosure;

said first side panel having a concave shape as viewed in top plan view, said first side panel including a generally horizontal stiffening element to maintain the concave shape, said concave shape including a generally vertical central panel with generally vertical margins defining edges of the first side panel; and a pair of carrying handles, one of said handles attached to the first side panel and the other handle attached to the second side panel, the handle attached to the first side panel being attached to the margins.

2. The luggage of claim 1 wherein the handles each comprise a strap with opposite ends of the strap attached to the associated side panel.

3. The luggage of claim 2 wherein the straps are each attached at approximately the same vertical distance from the bottom panel.

4. The luggage of claim 1 wherein the first side panel includes a horizontal rib as a stiffening member.

5. The luggage of claim 1, including a storage pouch on the second side panel.

6. The luggage of claim 1 wherein all the panels except the first side panel are generally flat planar panels.

7. The luggage of claim 1 wherein the end panels and side panels are all curved to define a smoothly curved plan profile having a kidney shape.

8. The luggage of claim 7 wherein the bottom panel is rigid and has the curved plan profile.

9. The luggage of claim 7 wherein the top panel includes a zipper opening to the enclosure defined along the intersection of the top panel and the first side panel.

* * * * *